United States Patent [19]

Ivins et al.

[11] 4,134,711

[45] Jan. 16, 1979

[54] SUBMERSIBLE PUMP APPARATUS

[75] Inventors: Earl E. Ivins; John L. Ivins, both of Lakewood, Calif.

[73] Assignee: Engineers Sales-Service Co., Inc., Los Angeles, Calif.

[21] Appl. No.: 745,332

[22] Filed: Nov. 26, 1976

[51] Int. Cl.[2] ..... F04B 17/00

[52] U.S. Cl. ..... 417/370

[58] Field of Search ..... 417/369, 370

[56] References Cited

U.S. PATENT DOCUMENTS

| | | | |
|---|---|---|---|
| 2,140,744 | 12/1938 | Hirsch | 134/200 X |
| 2,701,529 | 2/1955 | Finzel | 417/424 |
| 3,118,384 | 1/1964 | Sence et al. | 417/370 |
| 3,223,043 | 12/1965 | Shapiro | 417/370 |
| 3,407,099 | 10/1968 | Schell | 148/153 |

FOREIGN PATENT DOCUMENTS

| | | | |
|---|---|---|---|
| 1403238 | 11/1968 | Fed. Rep. of Germany | 417/369 |

*Primary Examiner*—John J. Vrablik
*Assistant Examiner*—R. E. Gluck
*Attorney, Agent, or Firm*—Fulwider, Patton, Rieber, Lee & Utecht

[57] ABSTRACT

A submersible pump apparatus including a fluid distribution system for injection of fluids into one or more areas adjacent the pump. In one embodiment an apertured ring directs water downwardly onto the motor case for cooling the pump, permitting the pump to run in an unsubmerged condition and thereby pump down to a lower fluid level, and stripping away debris, grease, and other unwanted material collections. Another apertured ring can be used to spray water upwardly against the motor case or against any surrounding sump walls to roil and mix the material to be pumped, such as in sewage, chemical, or industrial waste applications. The apertured ring may carry fluid for floating away accumulated grease or debris on the motor case, or may be used to apply foam or carbon dioxide to the pump in the event of a fire. A further fluid distribution system flushes the motor shaft seal area, and in yet another embodiment gases or liquids are injected into the low pressure vortex area of the pump to control the pumping capacity of the pump or to achieve other objects, depending upon the character of the gas or liquid which is injected.

2 Claims, 12 Drawing Figures

FIG. 1
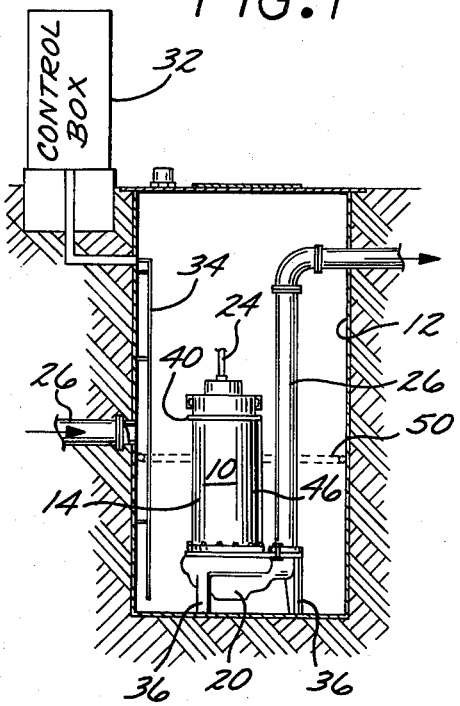
FIG. 2
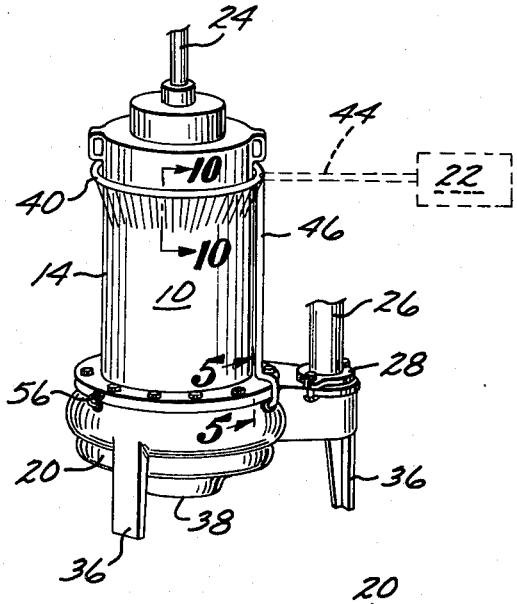
FIG. 4
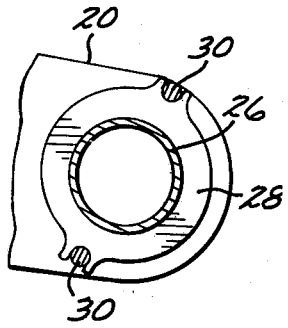
FIG. 3
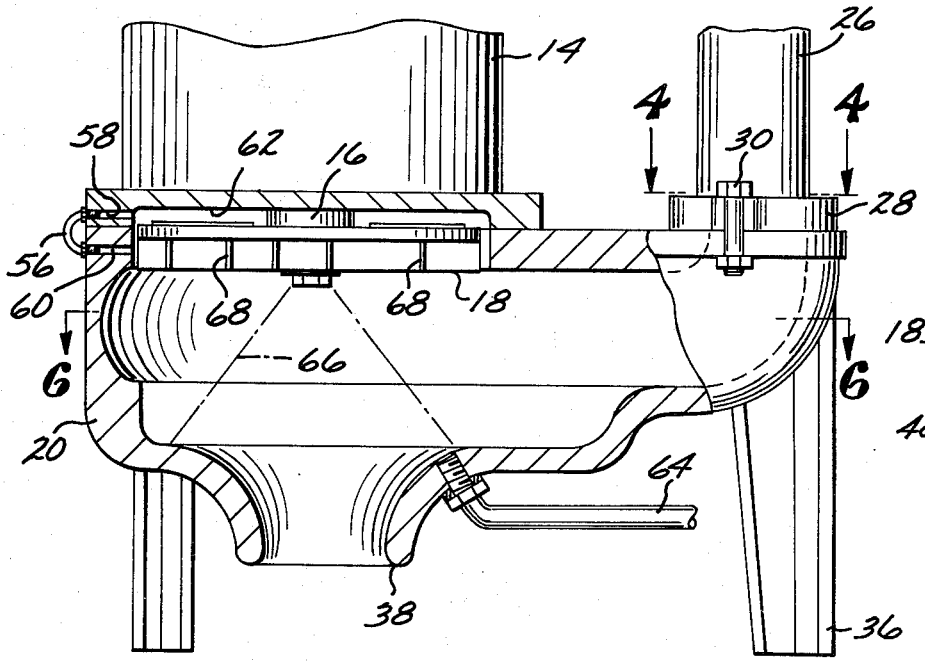
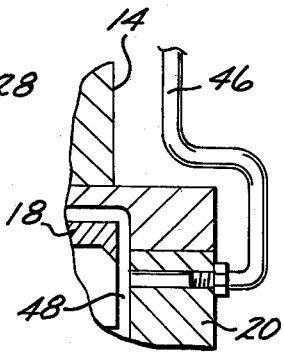
FIG. 5

SUBMERSIBLE PUMP APPARATUS

BACKGROUND OF THE INVENTION

1. Field of the Invention

The present invention relates to submersible pumps provided with means to direct fluid to one or more regions adjacent the pump.

2. Description of the Prior Art

The usual submersible pump is designed to be run in a submerged condition and normally becomes overheated when run in an unsubmerged condition, which sometimes results in an explosion, excess current loads or various forms of pump failure. Consequently, in a typical application such as sewage or industrial waste pumping, the sump for the pump must be deep enough to cover the vertically oriented pump with the material to be pumped. Controls are provided to prevent pumping of the material below the upper extremeity of the pump.

Debris, grease and sludge often coat the motor case and insulate it so that it overheats. Such accumulated grease and sludge fail to pass through the pump in the absence of any means to mix such materials with the more liquid portions of the material being pumped.

The usual submersible pumps of the prior art have no means to prevent the accumulation of sand and grit in the motor drive shaft seal area and such pumps are periodically taken out of service for maintenance or replacement of such seals.

Yet another problem with prior art submersible pumps is that there is no relatively inexpensive and simple way to vary the pumping capacity of such pumps to accommodate differential rates of flow of the material being pumped.

SUMMARY OF THE INVENTION

According to the present invention, there is provided a fluid distribution or conduit means coupled to a source of fluid and operative to direct such fluid into one or more regions adjacent a submersible pump of the type adapted for disposition in a sump for pumping material out of the sump. The pump includes a motor case, a shaft seal, a drive shaft coupled to the pump motor and extending downwardly from the motor case through the shaft seal, and an impeller coupled to the drive shaft for rotation of the impeller in a case located below the motor case. In a typical pumping application, such as the pumping of sewage out of a sump, the present fluid distribution or conduit means may include an apertured ring located in surrounding relation to the motor case and operative to direct cooling liquid onto the motor case. The ring can be mounted on the motor case, on the pump discharge pipe, or on the adjacent walls of the sump, and the ring may draw the cooling liquid from a surface source or from an area adjacent the impeller. In the latter case, this also vents the impeller to maintain its prime. The pump is thus able to operate at full power in an unsubmerged condition and, in certain instances, can be operated in an overloaded condition by reason of the improved cooling.

The present conduit means may include a conduit terminating adjacent the drive shaft seal to flush dirt and grit away from the seal area, the flushing material being drawn from a surface source or from the pump impeller discharge area.

In yet another embodiment of the invention the submersible pump includes a conduit terminating adjacent the low pressure vortex area of the impeller, which provides a number of important features. Compressed air applied to the conduit is useful to oxygenate the material being pumped. Air carried by the conduit can be employed to vary the volume of material being pumped and thereby adjustably control the pump output according to the amount of air injected. The conduit can be used to apply any of a number of gases or liquids to enhance or produce a desired chemical reaction in certain industrial applications. In this regard, certain special purpose liquids could be injected through the conduit to produce a blended mixture. Water could also be applied through the conduit to sluice or liquify heavy slurries, or to reprime the impeller.

Other objects and features of the invention will become apparent from consideration of the following description taken in connection with the accompanying drawings.

BRIEF DESCRIPTION OF THE DRAWINGS

FIG. 1 is a partially diagrammatic view of a submersible pump and conduit means according to the present invention, the pump being located in a typical sump for pumping sewage or industrial waste materials;

FIG. 2 is a perspective view of the submersible pump and conduit means, with the conduit means taking the form of an apertured ring, the connection of the ring to the impeller area being shown in full line, and an alternate connection to an external source of fluid being shown in dash-dot outline;

FIG. 3 is an enlarged cross sectional view of the lower portion of the pump, particularly including the impeller and impeller case area;

FIG. 4 is a view taken along the line 4—4 of FIG. 3;

FIG. 5 is an enlarged view taken along the line 5—5 of FIG. 2;

DESCRIPTION OF THE PREFERRED EMBODIMENT

Figure 6:
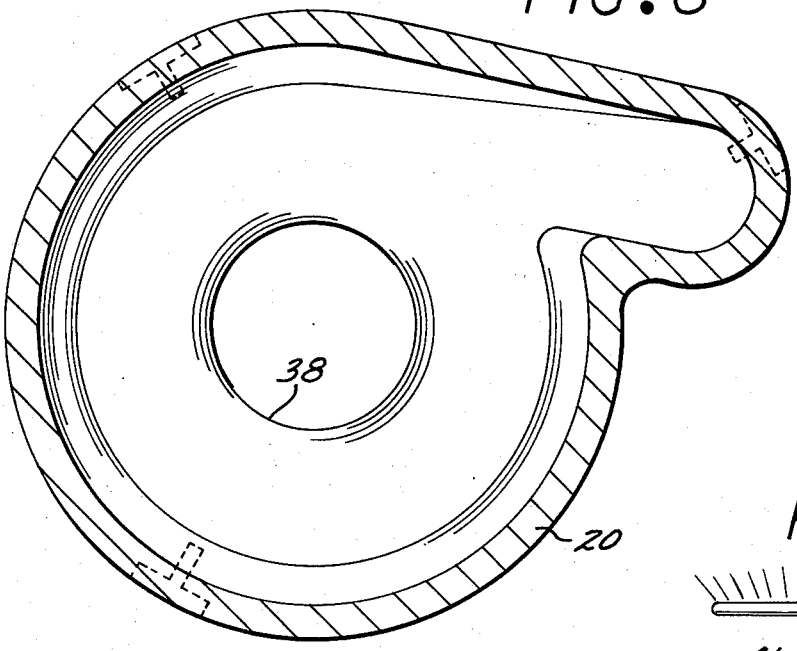
FIG. 6 is a view taken along the line 6—6 of FIG. 3.

Referring now to the drawings, there is illustrated an elongated submersible pump 10 adapted for vertical orientation in a sump 12, and including a motor case 14; a drive shaft 16 which extends downwardly through a shaft seal 17 and which is coupled to a pump motor 19, generally indicated in dotted outline in FIG. 3 located in the motor case 14; and an impeller 18 located in an impeller case 20 and coupled to the drive shaft 16 to rotate the impeller 18 for pumping material out of the sump 12. Various forms of fluid distribution or conduit means are employed to direct fluid into various regions adjacent the pump 10. As will be seen, some of these may be coupled to an external fluid source 22, indicated in dash-dot outline in FIG. 2, or the fluid source may be the material being pumped, in which case the fluid is drawn from a region adjacent the impeller 18.

The present pump apparatus is ideally suited for typical sewage pumping applications, but it is also adapted for use in a variety of other pumping applications, particularly applications in which it is desirable to pump the material down to a level near the bottom of the sump 12.

A submersible pump is sealed against fluid entry to enable it to be operated in a submerged condition. Although elaborate and expensive cooling jackets or the like have been utilized to cool such a sealed pump, the usual prior art pump is designed to be cooled by submergence in the liquid being pumped. Consequently, dangerous overheating occurs if care is not taken to operate such a pump in a submerged condition, and such overheating can result in excess current drain and possible burning or explosion of the motor. Therefore, the sump within which the pump is to operate must be made deep enough to cover the pump motor case and also accommodate usual fluctuations in the level of sewage, fluids or slurries above the motor case. Such a deep sump is shown in FIG. 1. As will be seen the present invention permits the sump to be made of lesser depth since the present pump 10 is capable of pumping the liquid down to the pump suction inlet, that is, a level approximately the level of the impeller case 20. When pumped down to this level, the suction is broken and this allows continuous operation at no load, until the fluid level rises and the pump impeller is reprimed.

Referring to FIG. 1, the pump 10 is provided with power by means of a cable 24 connected to an external power source. Liquid to be pumped enters an inlet pipe 25 and is pumped out of the sump 12 through a discharge pipe 26 connected at its flanged end 28 to the impeller case 20 by a pair of nut and bolt assemblies, as best seen in FIGS. 3 and 4.

A typical system for controlling operation of the pump 10 includes controls in a surface or exterior unit 32 which are coupled to a tube 34. The tube 34 extends downwardly into the sump 12, the open lower end of the tube 34 being located at the desired lowest level for the material being pumped. The controls in the unit 32 are responsive to the difference in back pressure which results when the lower end of the tube 34 is exposed to ambient pressure as the liquid level drops below the lower end of the tube 34. When this occurs power to the pump 10 is cut off. Such controls are well known to those skilled in the art and a detailed explanation of their operation is omitted for brevity. However, as will be seen, with the present invention the control system can be modified to reduce or eliminate starting and stopping of the pump motor each time the liquid level drops to the level of the pump suction inlet. The present pump apparatus, at that level, is able to operate continuously in a "free-wheeling" or no-load condition until the level rises again to reprime the impeller.

The impeller case 20 includes a plurality of supporting legs 36 which space the impeller inlet 38 the desired distance above the floor of the sump 12, as best seen in FIG. 3.

Figure 10:
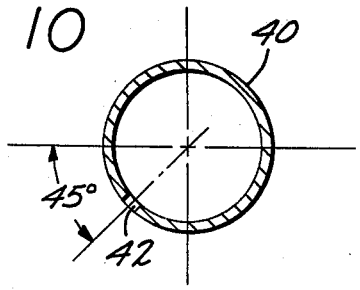
FIG. 10 is an enlarged view taken along the line 10—10 of FIG. 2.

As best seen in FIG. 2, a conduit in the form of a circumferential tube or ring 40 is mounted in any suitable manner to the upper extremity of the motor case 14. As seen in FIG. 10, the ring 40 includes a plurality of uniformly circumferentially spaced openings or apertures 42 which are preferably inwardly and downwardly directed at an angle of approximately 45° below the horizontal so that cooling liquid from the ring 40 is directed downwardly onto the exterior surface of the motor case 14.

The cooling liquid can be applied to the ring 40 from an external water supply or other source 22 through suitable piping 44, as seen in FIG. 2. The cooling liquid can be the material being pumped, in which case it can be tapped from the discharge pipe 26 (not shown). However, it is preferred to draw the liquid from the impeller case 20, thereby also venting the recessed area 62 in which the impeller 18 operates and thus tending to maintain the prime of the pump. An unexpected advantage of such an arrangement is that venting of the impeller area at the level of the ring 40, which is above the normal level of the liquid material being pumped, tends to be more efficient since there is a greatly reduced back pressure compared with venting of the impeller area through a conduit opening into the liquid adjacent the impeller case 20.

Liquid from the impeller area is drawn through a vertically oriented tube 46 in fluid communication at its upper end with the ring 40, and at its lower end with the high pressure discharge area adjacent the impeller 18, as generally indicated by the numeral 48 in FIG. 5.

Although only a small percentage of the output of the impeller 18 passes through the tube 46 to the ring 40, the pump 10 is sufficiently cooled to enable its operation in an unsubmerged condition.

Instead of being mounted to the motor case 14, the ring 40 could be arranged above the pump, or mounted in any suitable manner to adjacent structure, such as the wall of the sump 12, as shown in dotted outline at 50 in FIG. 1. In any case the apertures 42 would be suitably oriented to direct the cooling liquid onto the exterior of the motor case 14.

As will be apparent, the external source 22 may be a source of carbon dioxide or flame smothering foam, in which case the apertured ring could be utilized to snuff out a fire in the sump or to stop burning of a defective pump motor.

Figure 11:
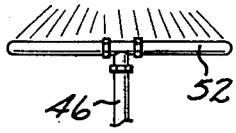
FIG. 11 is a side elevational view of an apertured ring adapted to be mounted to the bottom extremity of the pump casing for directing fluid upwardly and inwardly.

In certain applications an auxiliary apertured ring 52 as seen in FIG. 11 is mounted adjacent the lower extremity of the motor case 14, and is employed to direct fluid upwardly and inwardly against the motor case 14. The ring 52 may be supplied with gas or liquid from an external source or with liquid from the impeller area, as previously described in connection with the ring 40, to rinse or sluice accumulations of debris, grease and sludge from the motor case 14.

Figure 12:
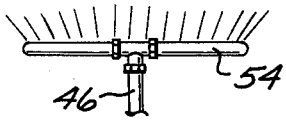
FIG. 12 is a side elevational view of an apertured ring adapted to be mounted to the pump case for directing fluid upwardly and outwardly against the walls of the sump.
Figure 7:
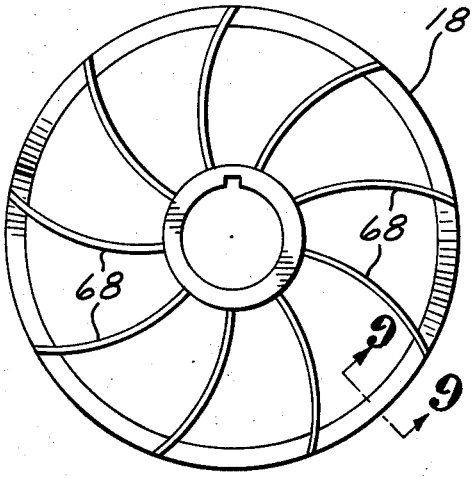
FIG. 7 is a bottom plan view of the underside of the impeller.
Figure 8:
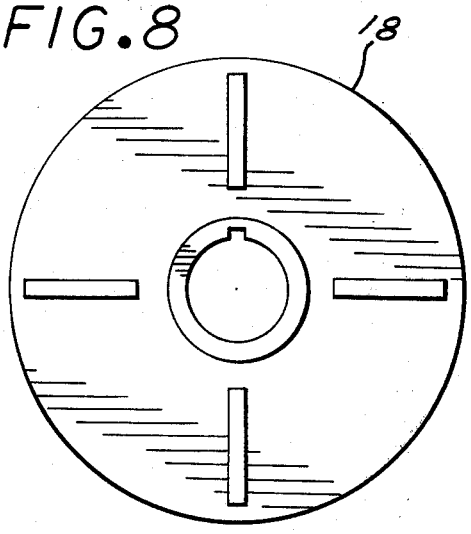
FIG. 8 is a top plan view of the impeller.

An apertured ring 54, as seen in FIG. 12, may also be mounted to the lower extremity of the motor case 14. Its apertures are directed outwardly as illustrated to spray fluid onto the interior walls of the sump and sluice off accumulated grease and sludge. Such an arrangement also tends to roil or mix the material in the sump 12 so that semi-solid materials pass through the pump along with the more liquid components.

In yet another embodiment, a conduit 56 is provided to direct fluid into the areas of the shaft seal 17 adjacent the drive shaft 16 to flush away abrading dirt or sand as best seen in FIG. 3. One end of the conduit 56 is attached to the flange or lower portion 63 of the motor case 14 in fluid communication with a passage 58 opening into a recessed impeller area 62 formed in the lower portion 63 of the motor case 14. The other end of the conduit 56 is attached to the impeller case 20 in fluid communication with a passage 60 opening into the discharge area of the impeller 18. Liquid under pressure from the passage 60 passes through the conduit 56 and the passage 58 into the recessed area 62 adjacent the seal 17 of the drive shaft 16. If desired, the conduit 56 could be provided with liquid from an external source, as previously described in connection with the operation of the apertured ring 40.

Yet another conduit 64 is provided according to the present invention. The conduit 64 is part of a novel arrangement which achieves a number of important objects not heretofore possible with prior art submersible pumps.

Figure 9:
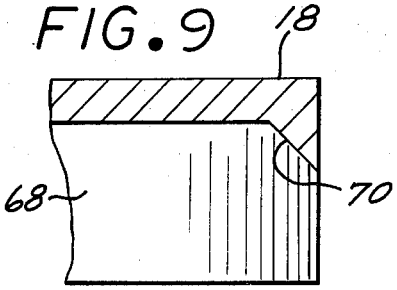
FIG. 9 is an enlarged view taken along the line 9—9 of FIG. 7.

In a vertically oriented submersible pump there is characteristically a generally conical low pressure vortex area 66 having its base adjacent the impeller inlet 38 and its apex just below the impeller 18. Material to be pumped is drawn upwardly by this low pressure region into the impeller 18. The plurality of radially directed impeller blades 68 thereafter thrust the material outwardly. The impeller 18 is provided with an angularly inclined flange 70, as best seen in FIG. 9, which directs the outwardly thrust material downwardly, away from the recessed area 62, and into the discharge pipe 26.

One end of the conduit 64 is connected to the impeller case 20 in fluid communication with the interior of the impeller case 20 adjacent the base of the vortex area 66. The other end of the conduit 64 is coupled to an external source such as the source 22. The source 22 may be a source of compressed air, in which case air introduced into the vortex area 66 operates to control the pumping capacity of the pump 10. Such a control is a relatively simple and inexpensive means for varying the output of the pump as desired, the effect of the air being to displace some of the liquid material which would otherwise be pumped. In contrast, the methods of the prior art utilized to adjust the level of pump output are generally more expensive and complex and less efficient.

Compressed air injected through the conduit 64 is also useful in certain sewage applications to oxygenate the material being pumped.

Other gases or liquids may also be injected by means of the conduit 64 to enhance or produce chemical reactions in the material being pumped.

Water injected through the conduit 64 is useful to sluice or liquify heavy slurries or sand deposits, and such water is also useful in repriming the impeller when that becomes necessary. The conduit 64 is surprisingly effective in the aforementioned applications because of the utilization of the low pressure character of the vortex area 66 to efficiently introduce liquids and gases of the required character into the pump effluent, with resulting sparge-mixing.

Various modifications and changes may be made with regard to the foregoing detailed description without departing from the spirit of the invention.

I claim:

1. In an elongated submersible pump adapted for vertical orientation in a sump or the like and having a pump motor and a motor case, shaft seal means, a drive shaft coupled to the pump motor and extending downwardly from the motor case through the shaft seal means, an impeller coupled to the drive shaft for rotation of the impeller in an impeller case located below the motor case for pumping material out of the sump, the improvement comprising:

first conduit means including a ring located in surrounding relation to the upper extremity of said motor case;

second conduit means connected at one end thereof to said ring and at the other end thereof to a high pressure discharge portion of the impeller case adjacent the impeller, said second conduit means establishing liquid and gaseous fluid communication between said ring and the interior of said impeller case;

said ring having apertures for venting gases from said impeller case and for directing fluid from said impeller case onto said upper extremity of said motor case, whereby the pump may be cooled by fluid from said impeller case for running in an unsubmerged condition, whereby any gases in said impeller case may be vented through the apertures in said ring, and whereby any foreign accumulations on said motor case tend to be washed away.

2. A submersible pump according to claim 1 further comprising third conduit means terminating at a first end thereof adjacent said shaft seal means and connected at the other end thereof to said impeller case, said third conduit means establishing fluid communication between the interior of said impeller case and the area adjacent said shaft seal means, whereby said shaft seal means can be flushed with fluid from said impeller case.

* * * * *